US010771899B2

(12) United States Patent
Lee et al.

(10) Patent No.: US 10,771,899 B2
(45) **Date of Patent: *Sep. 8, 2020**

(54) DISPLAY APPARATUS

(71) Applicant: LG Display Co., Ltd., Seoul (KR)

(72) Inventors: Sungtae Lee, Incheon (KR); SeYoung Kim, Seoul (KR); Kwangho Kim, Osan-si (KR); Hogeol Lim, Incheon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/701,103

(22) Filed: Dec. 2, 2019

(65) Prior Publication Data

US 2020/0107129 A1 Apr. 2, 2020

Related U.S. Application Data

(63) Continuation of application No. 16/120,602, filed on Sep. 4, 2018, now Pat. No. 10,547,948.

(30) Foreign Application Priority Data

Nov. 30, 2017 (KR) ..... 10-2017-0163410

(51) Int. Cl.

| | |
|---|---|
| ***H04R 7/04*** | (2006.01) |
| ***H04R 1/02*** | (2006.01) |
| ***H04R 9/02*** | (2006.01) |
| ***H04R 9/06*** | (2006.01) |

(52) U.S. Cl.

CPC ..... *H04R 7/045* (2013.01); *H04R 1/028* (2013.01); *H04R 9/025* (2013.01); *H04R 9/06* (2013.01); *H04R 2440/05* (2013.01); *H04R 2499/15* (2013.01)

(58) Field of Classification Search

CPC .... H04R 2499/15; H04R 1/028; H04R 7/045; H04R 9/06; H04R 9/025

See application file for complete search history.

(56) References Cited

U.S. PATENT DOCUMENTS

| | | | |
|---|---|---|---|
| 2015/0341714 | A1 | 11/2015 | Ahn et al. |
| 2017/0280215 | A1 | 9/2017 | Lee et al. |
| 2017/0280216 | A1 | 9/2017 | Lee et al. |
| 2017/0280246 | A1 | 9/2017 | Choi et al. |
| 2017/0287990 | A1 | 10/2017 | Choi et al. |
| 2017/0289694 | A1 | 10/2017 | Choi et al. |
| 2018/0317011 | A1 | 11/2018 | Choi et al. |

FOREIGN PATENT DOCUMENTS

| | | | |
|---|---|---|---|
| CN | 105096778 | A | 11/2015 |
| CN | 107295447 | A | 10/2017 |

OTHER PUBLICATIONS

First Notification of Office Action dated Oct. 30, 2019, issued in corresponding Chinese Patent Application No. 201811074310.2.

*Primary Examiner* — Regina N Holder

(74) *Attorney, Agent, or Firm* — Morgan, Lewis & Bockius LLP

(57) ABSTRACT

A display apparatus includes: a display panel configured to display an image by emitting light, a rear structure configured to support the display panel, a vibration generator configured to vibrate the display panel, and a supporting member between the display panel and the vibration generator, the supporting member being configured to maintain a distance between the display panel and the vibration generator.

20 Claims, 6 Drawing Sheets

DISPLAY APPARATUS

CROSS-REFERENCE TO RELATED APPLICATION(S)

This application is a continuation of U.S. patent application Ser. No. 16/120,602, filed on Sep. 4, 2018, which claims the benefit of and priority to Korean Patent Application No. 10-2017-0163410, filed on Nov. 30, 2017, the entirety of each of which is hereby incorporated by reference.

BACKGROUND

1. Technical Field

The present disclosure relates to a display apparatus.

2. Discussion of the Related Art

With the advancement of an information-oriented society, various desires for the display field of expressing information in accordance with an electrical information signal are increasing. Thus, research is being conducted on various display apparatuses that are thin, light, and have low power consumption. For example, a display apparatus may include a liquid crystal display (LCD) apparatus, a field emission display (FED) apparatus, an organic light-emitting display (OLED) apparatus, etc.

A display apparatus may display an image on a display panel, but an additional speaker for supplying sound has to be provided. If the speaker is provided in a display apparatus, the sound generated in the speaker advances toward a lower or rear portion of the display panel, instead of toward a front portion of the display panel. Thus, the sound does not advance toward a user who watches the image displayed on the display panel, so that it disrupts the user's immersion experience.

If the speaker is included in a set apparatus, such as television (TV), the speaker occupies a space that may impose a restriction on design and a spatial disposition of the set apparatus. To solve this problem, the display apparatus may output sound toward a front portion of the display panel, e.g., through vibration of the display panel.

However, a problem occurs in that a rolling phenomenon occurs in a vibration generator for vibrating the display panel. If the rolling phenomenon occurs in the vibration generator, the sound of the display device may be distorted, and sound deterioration is generated, whereby a problem occurs in that the vibration generator is not operated normally. To solve this problem, development of a display apparatus, which may reduce, or even prevent, a rolling phenomenon of a vibration generator from occurring, is desired.

SUMMARY

Accordingly, the present disclosure is directed to a display apparatus that substantially obviates one or more of the issues due to limitations and disadvantages of the related art.

An aspect of the present disclosure is to provide a display apparatus that reduces or prevents a rolling phenomenon, which may occur when a vibration generator vibrates a display panel, from occurring.

Another aspect of the present disclosure is to provide a display apparatus that reduces or prevents a rolling phenomenon of a vibration generator from occurring by interposing a supporting member between a display panel and the vibration generator.

Another aspect of the present disclosure is to provide a display apparatus that reduces or prevents sound distortion and deterioration from occurring by reducing or preventing a rolling phenomenon of a vibration generator from occurring.

Another aspect of the present disclosure is to provide a display apparatus that improves aesthetic design by omitting a space in which a speaker would be disposed separately, in addition to an area of a display panel, and improves a viewer's immersion experience by improving picture quality and sound quality.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided a display apparatus, including: a display panel configured to display an image by emitting light, a rear structure configured to support the display panel, a vibration generator configured to vibrate the display panel, and a supporting member between the display panel and the vibration generator, the supporting member being configured to maintain a distance between the display panel and the vibration generator.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

Figure 1:
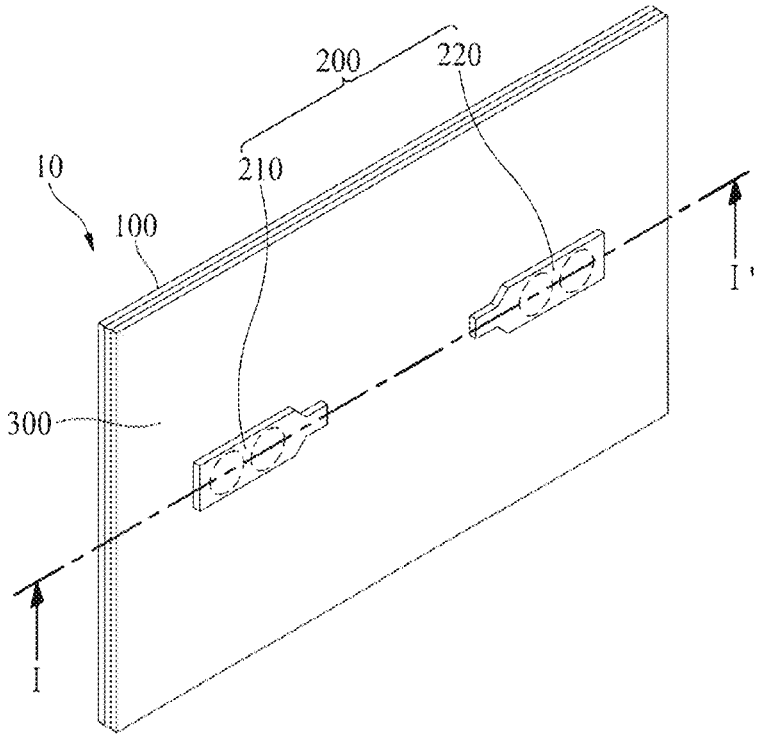
FIG. 1 is a perspective view of a display apparatus according to a first example embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range. In describing a position relationship, when a position relation between two parts is described as, for example, "on," "over," "under," or "next," one or more other parts may be disposed between the two parts unless a more limiting term, such as "just" or "direct(ly)," is used. In describing a time relationship, when the temporal order is described as, for example, "after," "subsequent," "next," or "before," a case which is not continuous may be included unless a more limiting term, such as "just," "immediate(ly)," or "direct(ly)," is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms like "first," "second," "A," "B," "(a)," and "(b)" may be used. These terms are merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers "disposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and embodiments of the present disclosure are not limited thereto.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

In the present disclosure, examples of a display apparatus are used to encompass a display apparatus, such as an organic light-emitting display module (OLED module) or a liquid crystal module (LCM), that may include a display panel and a driving unit for driving the display panel. The display apparatus may be used to further encompass a set device (or a set apparatus) or a set electronic apparatus, as a finished product, such as a notebook computer or a laptop computer, a television set, a computer monitor, an equipment apparatus (e.g., display equipment in an automotive apparatus or another type of vehicle apparatus) or a mobile electronic apparatus that may be a complete product or a final product (for example, a smartphone or an electronic pad, etc.) that may include the LCM or the OLED module. Therefore, in the present disclosure, the display apparatus may be used as the display apparatus itself, such as the LCM or the OLED module, and also as a set apparatus, which may be a final consumer apparatus or an application product including the LCM or the OLED module.

In some example embodiments, the LCM or the OLED module including a display panel and a driving unit thereof may be referred to as a "display apparatus," and the electronic apparatus as a final product including the LCM or the OLED module may be referred to as a "set apparatus." For example, the display apparatus may include a display panel, such as an LCD or an OLED, and a source printed circuit board (PCB) as a controller for driving the same. The set apparatus may further include a set PCB that may be a set controller that may be electrically connected to the source PCB, and may control the overall operations of the set apparatus.

A display panel applied to an embodiment may use any type of display panel, such as a liquid crystal display panel, an organic light-emitting diode (OLED) display panel, and an electroluminescent display panel, but embodiments are not limited to these specific types. For example, the display panel may be any panel capable of being vibrated by a sound generation device according to embodiments of the present disclosure to output sound. The shape and/or a size of a display panel applied to a display apparatus according to embodiments of the present disclosure are not limited.

For example, if a display panel is a liquid crystal display panel, the display panel may include a plurality of gate lines, a plurality of data lines, and a plurality of pixels respectively provided in a plurality of pixel areas of the gate lines and the data lines. Also, the display panel may include an array substrate including a thin film transistor (TFT), which may be a switching element for adjusting a light transmittance of each of the plurality of pixels, an upper substrate including a color filter and/or a black matrix, and a liquid crystal layer between the array substrate and the upper substrate.

In addition, if a display panel is an organic light-emitting display panel, the display panel may include a plurality of gate lines, a plurality of data lines, and a plurality of pixels respectively provided in a plurality of pixel areas of the gate lines and the data lines. The display panel may include an array substrate including a TFT, which may be an element for selectively applying a voltage to each of the pixels, an organic light-emitting device layer on the array substrate, and an encapsulation substrate disposed on the array substrate to cover the organic light-emitting device layer. The encapsulation substrate may protect the TFT and the organic light-emitting device layer from an external impact, and may prevent moisture or oxygen from permeating into the organic light-emitting device layer. A layer provided on the array substrate may include an inorganic light-emitting layer, for example, a nano-sized material layer, a quantum dot, or the like). The display panel may further include a backing, such as a metal plate attached on the rear surface of the display panel, but the backing is not limited to the metal plate, and another structure may be provided.

Hereinafter, a display apparatus according to example embodiments will be described in detail with reference to the accompanying drawings.

Figure 2:
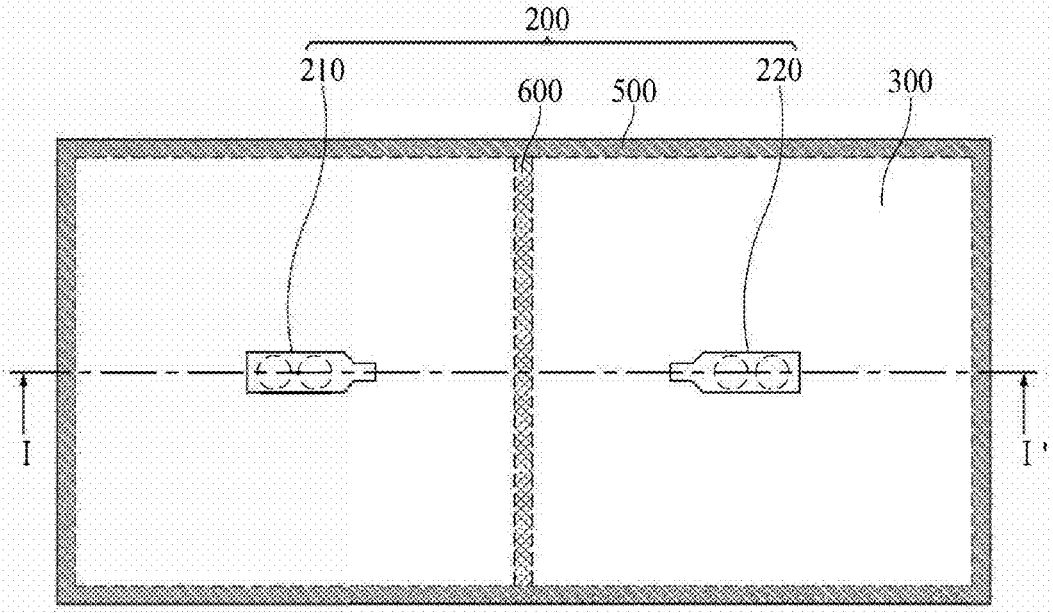
FIG. 2 is a rear view of a display apparatus of FIG. 1.
Figure 3:
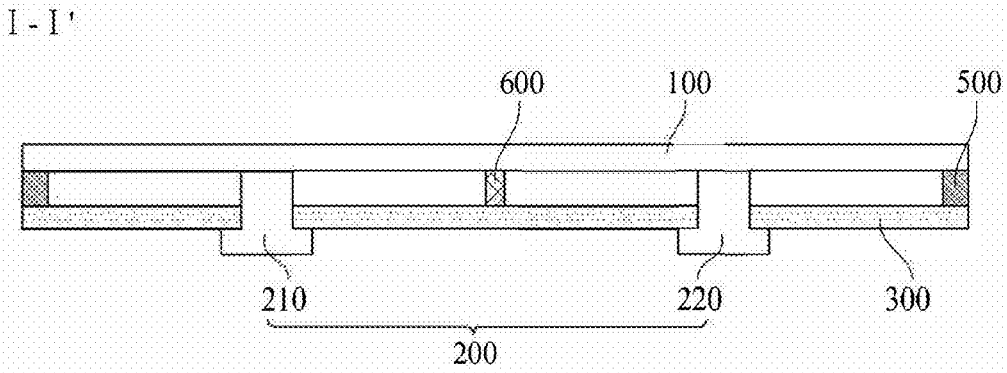
FIG. 3 is a cross-sectional view taken along line I-I' of FIGS. 1 and 2.

FIG. 1 is a perspective view of a display apparatus according to a first example embodiment of the present disclosure. FIG. 2 is a rear view of a display apparatus of FIG. 1. FIG. 3 is a cross-sectional view taken along line I-I' of FIGS. 1 and 2.

With reference to FIGS. 1 to 3, the display apparatus 10 may include a display panel 100, a vibration generator 200, a rear structure 300, an adhesive member 500, and a partition member 600. The display panel 100 may display an image, and may be realized as any kind of display panel, such as a liquid crystal display panel, an OLED display panel, and an electroluminescent display panel. The display panel 100 may be vibrated in accordance with vibration of the vibration generator 200 to output sound.

According to an embodiment of the present disclosure, the display panel 100 may display an image in the form of a top-emission mode, a bottom-emission mode, or a dual-emission mode in accordance with a structure of a pixel array layer that may include an anode electrode, a cathode electrode, and an organic compound layer. The top-emission mode may display an image by emitting visible light generated from the pixel array layer to the front portion of a base substrate, and the bottom-emission mode may display an image by emitting visible light emitted from the pixel array layer to the rear portion of the base substrate. The dual-emission mode may display an image by emitting visible light in both directions.

The vibration generator 200 may be on the rear surface of the display panel 100, and may vibrate the display panel 100. For example, the vibration generator 200 may be fixed to the rear structure 300, and may output sound to the front portion of the display panel 100 by vibrating the display panel 100. For example, the vibration generator 200 may generate sound by using the display panel 100 as a vibration plate.

The vibration generator 200 may directly vibrate the display panel 100 in contact with the rear surface of the display panel 100 by passing through the rear structure 300. According to an embodiment of the present disclosure, an upper portion of the vibration generator 200 may be inserted or accommodated into a hole in the rear structure 300, and then may be connected to the rear surface of the display panel 100. A lower portion of the vibration generator 200 may be fixed in contact with a rear surface of the rear structure 300. Therefore, the vibration generator 200 may be vibrated in accordance with a vibration signal corresponding to a sound signal related to an image to vibrate the display panel 100 by using the rear structure 300 as a support plate, and may output sound to the front portion of the display panel 100. Therefore, the display apparatus 10 may match a position where an image may be generated with a position where a sound may be generated by outputting the sound to the front portion, and not to the rear and lower portions of the display panel 100, using the display panel 100 as a vibration plate of a sound device. Thus, an immersion experience of a viewer who may view an image of the display apparatus 10 may be improved.

According to an embodiment of the present disclosure, the vibration generator 200 may include first and second sound-generating modules 210 and 220 that may vibrate different areas of the display panel 100. For example, the first and second sound-generating modules 210 and 220 may be fixed through the rear structure 300, and may be spaced apart from each other. For example, the display panel 100 may include a left area and a right area. It should be appreciated that the terms "left" and "right" are used herein for convenience and are interchangeable. The first sound-generating module 210 may overlap the left area of the display panel 100, and the second sound-generating module 220 may overlap the right area of the display panel 100. Therefore, the first sound-generating module 210 may be at a left side on the rear surface of the display panel 100 to vibrate the left area of the display panel 100, and the second sound-generating module 220 may be at a right side on the rear surface of the display panel 100 to vibrate the right area of the display panel 100. The first and second sound-generating modules 210 and 220 may be driven independently, e.g., by receiving their respective signals different from each other. For example, the first sound-generating module 210 may generate sound by using the left area of the display panel 100 as a vibration plate, and the second sound-generating module 220 may generate sound by using the right area of the display panel 100 as a vibration plate.

According to an embodiment of the present disclosure, the vibration generator 200, which may be a speaker, may be a "transducer," an "actuator," or "exciter," but embodiments are not limited to these terms. That is, the vibration generator 200 may be any sound device for outputting a sound in accordance with an electrical signal.

The rear structure 300 may be on the rear surface of the display panel 100 to support the display panel 100. For example, the rear structure 300 may be spaced apart from the display panel 100, and may support the vibration generator 200 in the rear structure 300.

The rear structure 300 may cover an entire portion of the rear surface of the display panel 100 such that it may be spaced apart from the rear surface of the display panel 100, and may have a plate-shape formed of a glass material, a metal material, and/or a plastic material, although embodiments are not limited thereto. For example, a periphery or sharp corner portion of the rear cover 301 may have a slope shape or curved shape, e.g., by a chamfering or trimming process, or corner rounding process. The rear structure 300 of a glass material may be a sapphire glass. For example, the rear structure 300 of a metal material may be formed of one or more of: aluminum (Al), an Al alloy, a magnesium (Mg) alloy, and/or alloy of iron (Fe) and nickel (Ni), although embodiments are not limited to these example. As another example, the rear structure 300 may have a stacked structure of a metal plate and a glass plate that is relatively thinner than the metal plate, facing the rear surface of the display panel 100. In this case, the rear surface of the display apparatus 10 may be used as a mirror surface by the metal plate.

The rear structure 300 may include a hole into which the vibration generator 200 may be inserted or accommodated. For example, the hole may be punctured in some area of the rear structure 300, e.g., to have a circular shape or polygonal shape along a thickness direction of the rear structure 300, whereby the vibration generator 200 may be inserted or accommodated into the hole.

The adhesive member 500 may be between the periphery of the display panel 100 and the periphery of the rear structure 300, and may adhere the display panel 100 to the rear structure 300. The adhesive member 500 may be on the rear structure 300 to support the periphery of the display panel 100. The adhesive member 500 may be a double-sided tape or a single-sided tape, but embodiments are not limited thereto. Also, the adhesive member 500 may seal a space between the display panel 100 and the rear structure 300.

The adhesive member 500 may include a foam pad including, for example, an acrylic based material, and an adhesive layer on each of front and rear surfaces of the foam pad. The adhesive member 500 may be an optically clear resin (OCR), an optically clear adhesive (OCA), and/or a double-sided tape. Embodiments are not limited to these examples.

The partition member 600 may be between the display panel 100 and the rear structure 300. The partition member 600 may be between the first and second sound-generating modules 210 and 220, and may separate areas in the first and second sound-generating generating modules 210 and 220. For example, the first sound-generating module 210 may vibrate the left area of the display panel 100, and the second sound-generating module 220 may vibrate the right area of the display panel 100. Therefore, the partition member 600 may reduce or prevent interference between sounds respectively generated in the left area and the right area of the display panel 100.

The partition member 600 may referred to as an "enclosure" or a "baffle," but embodiments are not limited to these terms. For example, the partition member 600 may be formed of a polyurethane or a polyolefin material, but embodiments are not limited thereto. The partition member 600 may be a one-sided tape or a double-sided tape, and may be formed of a material having elasticity that may be compressed to some extent.

The partition member 600 may separate left and right sounds generated in the first and second sound-generating modules 210 and 220 from each other. Because the partition member 600 may attenuate or absorb vibration of the display panel 100 at the center of the display panel 100, the partition member 600 may shield the sound at the left area of the display panel 100 from being transferred to the right area. Alternatively, the partition member 600 may shield the sound at the right area of the display panel 100 from being transferred to the left area. Therefore, because the partition member 600 may separate left and right sources from each other and output a stereo sound, the partition member 600 may improve a sound output characteristic. The partition member 600 may partition sounds generated by the first and second sound-generating modules 210 and 220, whereby a sound in the form of a 2.0 channel may be output from the display panel 100 in accordance with vibration of the display panel 100.

Figure 4:
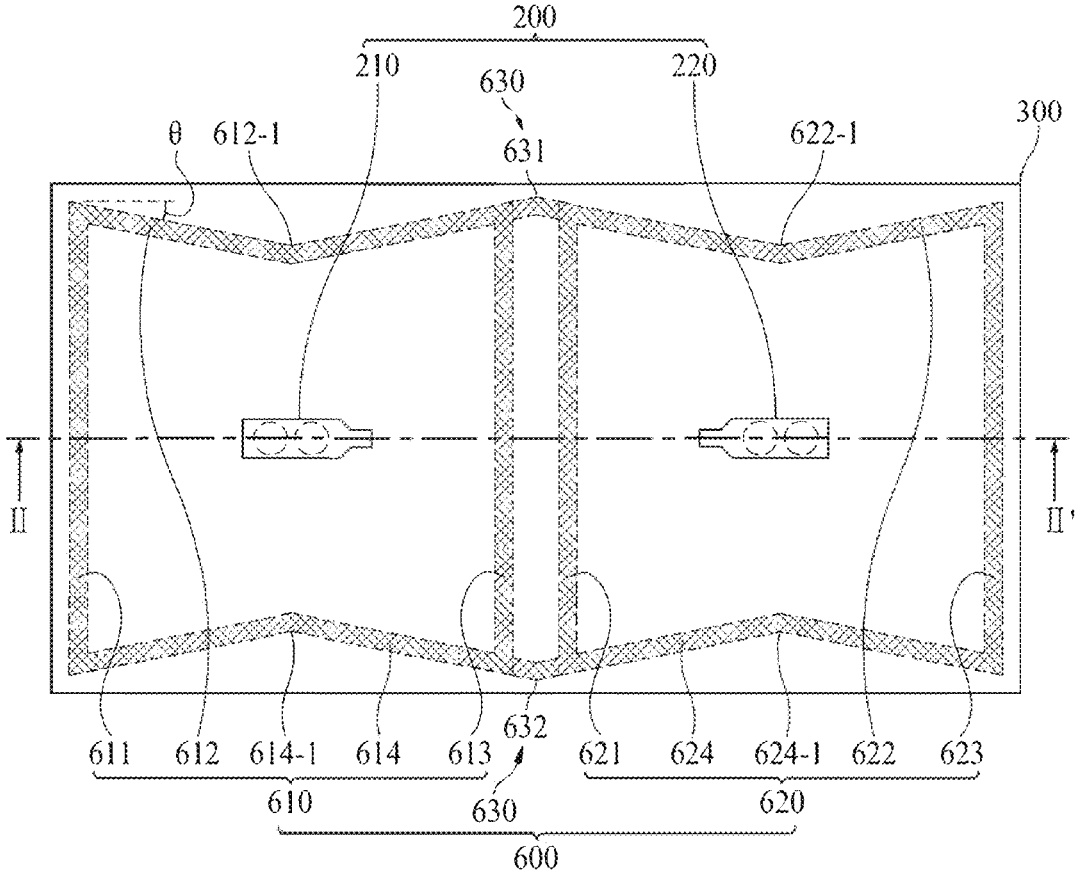
FIG. 4 is a rear view of a display apparatus according to a second example embodiment of the present disclosure.
Figure 5:
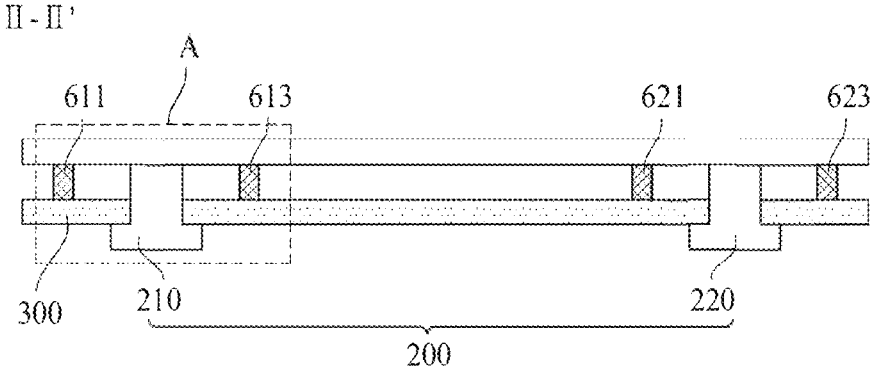
FIG. 5 is a cross-sectional view taken along line II-II' of FIG. 4.

FIG. 4 is a rear view of a display apparatus according to a second example embodiment of the present disclosure. FIG. 5 is a cross-sectional view taken along line II-II' of FIG. 4.

The display apparatus of the examples illustrated in FIGS. 4 and 5 is different from that of the examples illustrated in FIGS. 1 to 3 in the partition member 600. Hereinafter, the following description will be given based on the partition member 600, and repeated description of the other elements will be omitted or provided briefly.

With reference to the examples of FIGS. 4 and 5, the partition member 600 may include first to third partition members 610, 620, and 630. For example, the display panel 100 may include a left area, a right area, and a center area. The first partition member 610 may surround the left area of the display panel 100, the second partition member 620 may surround the right area of the display panel 100, and the third partition member 630 may surround the center area of the display panel 100. For example, the first partition member 610 or the second partition member 620 may be disposed along four sides outside the left area or the right area of the display panel 100, and the third partition member 630 may be between the first and second partition members 610 and 620. Each of the first to third partition members 610, 620, and 630 may output sound to only the front portion of the display panel 100, e.g., by shielding the sound from leaking through each side of the display panel 100, whereby a sound output characteristic may be improved.

Each of the first and second partition members 610 and 620 may include four sides, and the third partition member 630 may include two sides. For example, the first partition member 610 may include first to fourth sides 611, 612, 613, and 614; the second partition member 620 may include first to fourth sides 621, 622, 623, and 624; and the third partition member 630 may include first and second sides 631 and 632. As shown in FIG. 4, the first and second sides 631 and 632 of the third partition member 630 may have a bent shape, a straight line shape, or a round shape, but embodiments are not limited to these shapes. For example, each of the first to fourth sides 611, 612, 613, and 614 of the first partition member 610 may be different from each of the first to fourth sides 621, 622, 623, and 624 of the second partition member 620 in that it may be disposed at the left area or the right area of the display panel 100. Therefore, a description of the first to fourth sides 621, 622, 623, and 624 of the second partition member 620, which may be the same as those of the first to fourth sides 611, 612, 613, and 614 of the first partition member 610, will be omitted.

The partition member 600 may include a bent portion on at least one of the four sides. For example, each of the second side 612 and the fourth side 614 of the first partition member 610 may include a bent portion 612-1 or 614-1. Therefore, two up and down sides 612 and 614 of the four sides surrounding the left area of the display panel 100 may include a bent portion to have a certain inclined angle (θ) with respect to a horizontal direction of the display panel 100. The bent portion 612-1 may be configured with two straight-line portions, and may be formed at a position where the two straight-line portions contact each other. The bent portion 612-1 may have a straight line shape, a curved line shape, or a round shape, but embodiments are not limited thereto.

The inclined angle (θ) of the bent portion 612-1 may be set based on a requirement for restriction of the standing wave, and the inclined angle (θ) of the bent portion 712 may be set within a range, e.g., from about 10° to 30°. For example, in case of the sound output range for the low-pitched sound band or the large output of the sound-generating module, the inclined angle (θ) of the bent portion 612-1 may be relatively large. In a case of the sound output range for the high-pitched sound band or the small output of the sound-generating module, the inclined angle (θ) of the bent portion 612-1 may be relatively small.

The bent portion 612-1 may avoid or prevent a reduction of sound pressure level between the display panel 100 and the rear structure 300 from being generated. For example, sound waves generated by the display panel 100 through use of the vibration generator 200 may radially progress from the center of the vibration generator 200. These sound waves may be referred to as a "progressive wave." If the progressive wave is reflected on one side of the partition member 600, and progresses to an opposite direction, it may be referred to as a "reflected wave." If the reflected wave overlaps and interferes with the progressive wave, it may not progress, and it may be in a standing state, which may be referred to as a "standing wave." The standing waves may deteriorate the sound output characteristic by the reduction of sound pressure level. Therefore, to avoid or prevent the reduction of sound pressure level by the standing wave generated due to the interference between the reflected wave and the progressive wave, a bent portion may be provided in the partition member 600. The standing wave causing the reduction of sound pressure level may be generated at a point having the large the progressive wave and the large reflected wave. Therefore, the bent portion 612-1 may be disposed at the position having the largest sound wave approaching from the sound-generating module. The bent portion 612-1 may be bent toward the vibration generator 200.

The first to third partition members 610, 620, and 630 may be formed of a double-sided tape or single-sided tape, e.g., of a polyurethane or polyolefin material having a certain thickness (or height), but embodiments are not limited thereto. The first to third partition members 610, 620, and 630 may have elasticity that may be compressed to some extent, and may be referred to as an "enclosure" or a "baffle."

Figure 6:
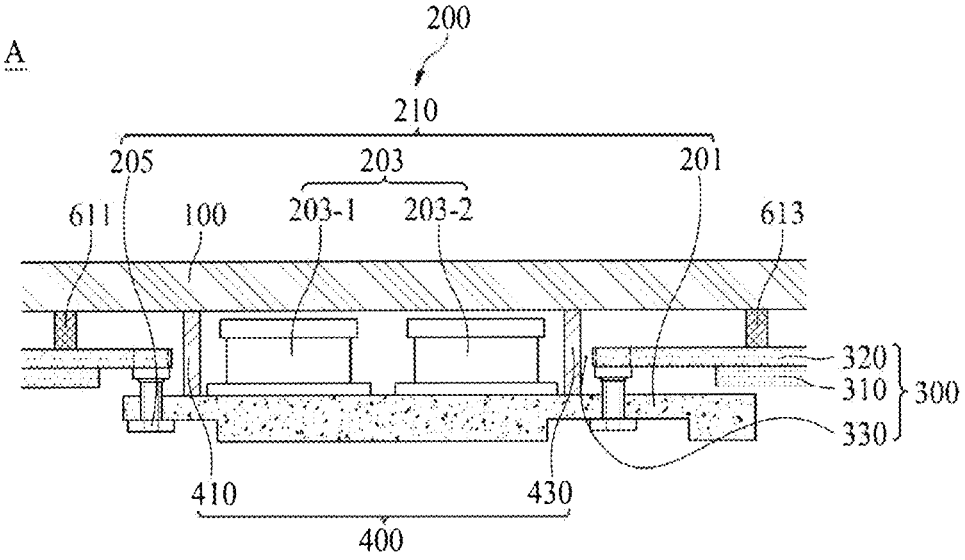
FIG. 6 is a cross-sectional view of an area A of FIG. 5 in accordance with a first example embodiment of a vibration generator.
Figure 7:
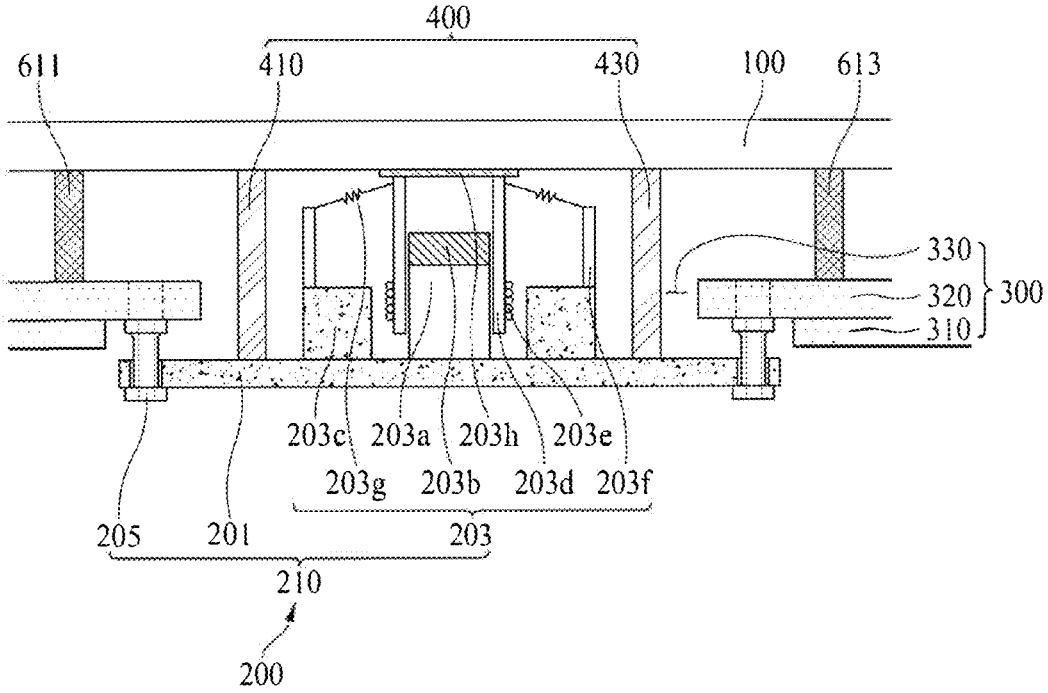
FIG. 7 is a cross-sectional view of elements of a vibration generator in a display apparatus of FIG. 6.
Figure 8:
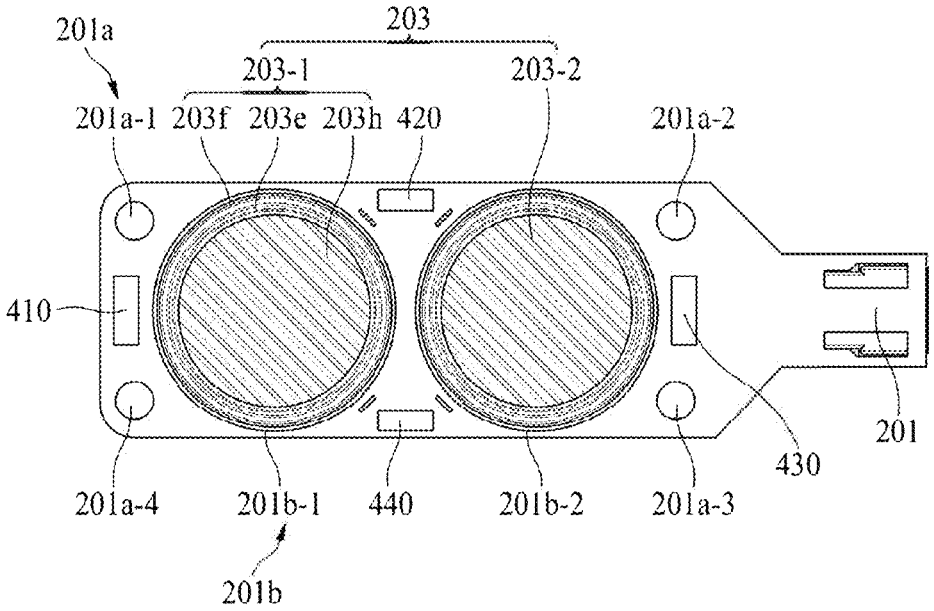
FIG. 8 is a perspective view of elements of a vibration generator in a display apparatus of FIG. 6.
Figure 9:
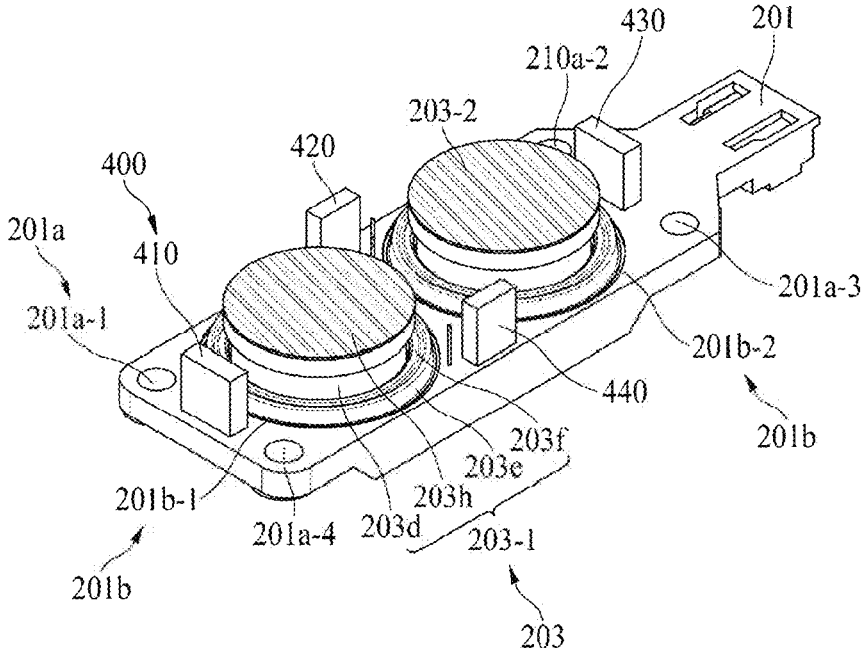
FIG. 9 is a plane view of elements of a vibration generator in a display apparatus of FIG. 6.

FIG. 6 is a cross-sectional view of an area A of FIG. 5 in accordance with a first example embodiment of a vibration generator. FIG. 7 is a cross-sectional view of elements of a vibration generator in a display apparatus of FIG. 6. FIG. 8 is a perspective view of elements of a vibration generator in a display apparatus of FIG. 6. FIG. 9 is a plane view of elements of a vibration generator in a display apparatus of FIG. 6.

With reference to the examples of FIGS. 6 to 9, the vibration generator 200 may include at least one sound-generating module 210 fixed to the rear structure 300, which may vibrate the display panel 100. At least one sound-generating module 210 may vibrate the display panel 100 in accordance with a current for generating a sound applied based on Fleming's Left Hand Rule for Motors. The vibration generator 200 may include a plurality of sound-generating modules, each of which may be symmetrically disposed based on a rear center of the display panel 100, but embodiments are not limited thereto.

The sound-generating module 210 may include a module frame 201, a vibration unit 203, and a plurality of connection members 205. The module frame 201 may be fixed to the rear structure 300 to overlap a hole 330 in the rear structure 300, and may support the sound-generating module 210. The module frame 201 may receive at least one vibration unit 203. For example, the vibration unit 203 may be referred to as a "transducer," an "actuator," or an "exciter." The module frame 201 may be fixed to the rear structure 300 to reduce or prevent vibration transferred to the rear portion of the sound-generating module 210. For example, the module frame 201 may efficiently transfer the vibration of the sound-generating module 210 to the display panel 100 by reducing or minimizing vibration loss generated from the rear portion of the sound-generating module 210. The module frame 201 may maintain a sound pressure level in the sound-generating module 210, and may improve a vibration characteristic of the sound-generating module 210, e.g., by forming a sealing space with the display panel 100.

The module frame 201 may include a plurality of connection areas 201*a* and a vibration area 201*b*. The plurality of connection areas 201*a* may receive a plurality of connection members 205. For example, the plurality of connection areas 201*a* may correspond to a connection member mounting hole through which the plurality of connection members 205 pass. The plurality of connection areas 201*a* may be aligned with a connection member mounting hole of a second structure member 320, and therefore may receive the plurality of connection members 205. Therefore, each of the plurality of connection members 205 may be accommodated in the plurality of connection areas 201, and may connect the module frame 201 to the rear structure 300.

The vibration area 201*b* may accommodate a vibration unit 203. The module frame 201 may include at least one vibration area 201*b*. The module frame 201 may include as many vibration units 203 as the number of vibration areas 201*b*. For example, the module frame 201 may include a plurality of vibration areas 201*b*, thereby accommodating a plurality of actuators or exciters.

According to an embodiment of the present disclosure, the plurality of connection areas 201*a* may surround the vibration area 201*b*, and may be spaced apart therefrom. For example, the vibration area 201*b* may be on a center area of the module frame 201, and the plurality of connection areas 201*a* may be on the peripheries or corners of the module frame 201. The plurality of connection areas 201*a* may be formed symmetrically with respect to the vibration area 201*b*. The plurality of connection areas 201*a* may be provided in various ways in accordance with the structure and shape of the module frame 201 and arrangement relation of the vibration area 201*b*. Therefore, the plurality of connection areas 201*a* may be formed symmetrically with respect to the vibration area 201*b*, and thus, the module frame 201 may be stably attached to the rear structure 300, in spite of vibration of the vibration unit 203.

The sound-generating module 210 may include first and second vibration units 203-1 and 203-2 that may be accommodated in one module frame 201. Therefore, the module frame 201 may include first to fourth connection areas 201*a*-1, 201*a*-2, 201*a*-3, and 201*a*-4; and may include first and second vibration areas 201*b*-1 and 201*b*-2. For example, each of the first and the second vibration areas 201*b*-1 and 201*b*-2 may accommodate each of the first and the second vibration units 203-1 and 203-2, and may be in parallel with a direction of a long side of the module frame 201. The first vibration area 201*b*-1 may be on the left side of the module frame 201, and the second vibration area 201*b*-2 may be on the right side of the module frame 201. The first to the fourth connection areas 201*a*-1, 201*a*-2, 201*a*-3, and 201*a*-4 may be respectively on the corners of the module frame 201, and may surround the first and the second vibration areas 201*b*-1 and 201*b*-2 to be spaced apart therefrom. Therefore, the first to the fourth connection areas 201*a*-1, 201*a*-2, 201*a*-3, and 201*a*-4 may stably attach the module frame 201 to the rear structure 300, in spite of vibration of the first and the second vibration units 203-1 and 203-2.

The module frame 201 may support a lower portion of a magnet member 203*a*. The module frame 201 may increase magnetic flux density flowing to the vibration unit 203 by controlling magnet flux formed through magnet member 203*a* with an upper plate 203*b*. For example, the module frame 201 may include one or more of: a silicon nitride, an aluminum nitride, a zirconium nitride, a titanium nitride, a hafnium nitride, a tantalum nitride, a silicon oxide, an aluminum oxide, and/or a titanium oxide, but embodiments are not limited thereto. Therefore, each of the module frame 201 and the upper plate 203*b* may be on each of the lower and upper portions of the magnet member 203*a*, and may improve a vibration characteristic by increasing magnetic flux density formed though the magnet member 203*a* and a coil 203*e*.

The vibration unit 203 may be on the module frame 201, and may vibrate the display panel 100. For example, using the module frame 201 as a supporting member, the vibration unit 203 may vibrate the display panel 100 in accordance with a vibration signal corresponding to a sound signal, e.g., related to images. The vibration unit 203 may include a magnet member 203*a*, an upper plate 203*b*, a side frame 203*c*, a bobbin 203*d*, a coil 203*e*, an external frame 203*f*, a damper 203*g*, and a bobbing ring 203*h*.

The magnet member 203*a* may be on the module frame 201. For example, the magnet member 203*a* may be between the upper plate 203*b* and the module frame 201, and may be surrounded to be spaced apart through the side frame 203*c*. When the upper plate 203*b* is on one portion of the magnet member 203*a*, and the module frame 201 is on another portion, which may be opposite to the one portion of the magnet member 203*a*, the upper plate 203*b* and the module frame 201 may control magnetic flux generated in the magnet member 203*a*. Therefore, when the magnet member 203*a* is between the upper plate 203*b* and the module frame 201, magnetic flux generated in the magnet member 203*a* may be concentrated toward the inside of the vibration unit 203, and a leakage magnet flux may be suppressed.

The magnet member 203*a* may be a permanent magnet, e.g., with a ring shape or a cylinder shape. For example, the magnet member 203*a* may be implemented, e.g., with a sintered magnet, for example, with a material, such as barium ferrite. A material of the magnet member 203*a* may include one or more of: ferric oxide ($Fe_2O_3$); barium carbonate (or witherite) ($BaCO_3$); neodymium (Nd); strontium ferrite ($Fe_{12}O_{19}Sr$), e.g., with an improved magnet component; and an alloy cast magnet including aluminum (Al), nickel (Ni), cobalt (Co), and/or the like. As another example, the neodymium magnet may be neodymium-iron-boron (Nd—Fe—B). However, embodiments are not limited to these examples.

The upper plate 203*b* may be on an upper portion of the magnet member 203*a*, and may be spaced apart from the display panel 100. When the magnet member 203*a* and the upper plate 203*b* are accommodated to the inside of the bobbin 203*d* with a cylinder shape, the outside surface of the magnet member 203*a* and the upper plate 203*b* may be surrounded by the bobbin 203*d*. Therefore, the magnet member 203*a* and the upper plate 203*b* may be guided by the bobbin 203*d* to perform a linear reciprocating motion. For example, the upper plate 203*b* may be referred to as a "center pole" or "pole pieces," etc. When the upper plate 203*b* is formed of a magnetic material, such as iron (Fe), magnetic flux density formed through the magnet member 203*a* may be increased.

The side frame 203*c* may be on the module frame 201, and may surround the lower part of the vibration unit 203 to be spaced apart therefrom. For example, the side frame 203*c* may be formed of a conductive material, and may control magnetic flux generated from the magnet member 203*a*. For example, the side frame 203*c* may concentrate the magnetic flux generated from the magnet member 203*a* into the vibration unit 203, e.g., to suppress a leakage magnetic flux by surrounding the magnet member 203*a* to be spaced apart therefrom. Therefore, the upper plate 203*b* may be on the upper portion of the magnet member 203*a*, the module frame 201 may be on the lower portion of the magnet member 203*a*, and the side frame 203*c* may suppress a leakage magnetic flux generated from the magnet member 203*a* by surrounding the sides of the magnet member 203*a* to be spaced apart therefrom, thereby increasing magnetic flux density and improving a vibration characteristic.

For example, the side frame 203*c* may include one or more of: a silicon nitride, an aluminum nitride, a zirconium nitride, a titanium nitride, a hafnium nitride, a tantalum nitride, a silicon oxide, an aluminum oxide, and/or a titanium oxide, but embodiments are not limited thereto. The side frame 203*c* may include the same material as that of the module frame 201, or may be a material different from that of the module frame 201. The side frame 203*c* may be formed in a single body with the module frame 201, or may be attached to the module frame 201 after the module frame 201 is formed. The side frame 203*c* may be referred to as other terms, such as a "yoke," but embodiments are not limited thereto.

The bobbin 203*d* may surround the upper plate 203*b*, and may be attached to the rear surface of the display panel 100 through the bobbin ring 203*h*. For example, the bobbin 203*d* may surround the magnet member 203*a* and the upper plate 203*b*, and may be surrounded by the side frame 203*c* to be spaced apart therefrom. For example, when a sound-generating current is applied to the coil 203*e* wound on the outer circumference of the bobbin 203*d* and a magnet field is formed inside the vibration unit 203, the bobbin 203*d* may vibrate the display panel 100 by means of the magnetic field by using the bobbin ring 203*h* as a medium. Therefore, a front surface of the bobbin 203*d* may be in contact with the bobbin ring 203*h*, whereby the bobbin 203*d* may vibrate the display panel 100 through the bobbin ring 203*h* in accordance based on a current being applied or not. The display panel 100 may generate a sound wave by receiving the vibration, and the sound wave may be output to the front portion of the display panel 100. For example, the bobbin 203*d* may include a material with low heat conductivity, through which the magnetic flux may pass. For example, the bobbin 203*d* may be a cylinder structure including a material processed with, e.g., pulp or paper, synthetic resins, such as aluminum (Al), magnesium (Mg), an aluminum alloy, a magnesium alloy, a polypropylene, and polyamide-based fiber. However, embodiments are not limited to these examples.

The coil 203*e* may be wound on the outer circumference of the bobbin 203*d*, and may surround the magnet member 203*a* to be spaced apart therefrom. For example, the coil 203*e* may be wound on the outer circumference of the bobbin 203*d*, may surround the magnet member 203*a* to be spaced apart therefrom, and may be supplied with a sound-generating current. For example, the coil 203*e* may be referred to as a "voice coil." If the sound-generating current is applied to the coil 203*e*, the bobbin 203*d* may be vibrated by being guided by the damper 203*g* in accordance with Fleming's Left-Hand Rule for Motors, based on the applied magnetic field formed around the coil 203*e* and an external magnetic field formed around the magnet member 203*a*. For example, the magnetic flux generated by the magnetic field may flow along a closed-loop connected to the coil 203*e*, the side frame 203*c*, the module frame 201, the magnet member 203*a*, the upper plate 203*b*, and the coil 203*e* again. Therefore, the bobbin 203*d* may be vibrated while being guided by the damper 203*g*, and then may transfer vibration to the display panel 100.

The external frame 203*f* may be on the side frame 203*c*. For example, the external frame 203*f* may extend from the outside of the upper portion of the side frame 203*c* to the display panel 100. The external frame 203*f* may be spaced apart from the bobbin 203*d* in parallel with the bobbin 203*d*. The upper portion of the external frame 203*f* may be connected to the damper 203*g* to support one portion of the damper 203*g*. Therefore, while the other portion of the damper 203*g* may be connected to the bobbin 203*d*, and may guide the vibration of the bobbin 203*d*, the external frame 203*f* may be fixed to the upper portion of the side frame 203*c* to support one portion of the damper 203*g*.

The damper 203*g* may be between the external frame 203*f* and the bobbin 203*d* to guide vibration of the bobbin 203*d*. For example, one portion of the damper 203*g* may be connected to the upper portion of the external frame 203*f*, and the other portion of the damper 203*g* may be connected to the bobbin 203*d*. The damper 203*g* may be formed with a structure that may be wrinkled between the one portion and the other portion, and therefore may control and guide vibration of the bobbin 203*d* by being contracted and relaxed in accordance with linear reciprocating motion of the bobbin 203*d*. Therefore, the damper 203*g* may be connected between the external frame 203*f* and the bobbin 203*d*, thereby controlling a vibration distance of the bobbin 203*d* by a restoring force of the damper 203*g*. For example, if the bobbin 203*d* vibrates to be higher or lower than a particular height, the bobbin 203*d* may be restored to its original position by the restoring force of the damper 203*g*. The damper 203*g* may be referred to by other terms such as a "spider," a "suspension," and an "edge."

The bobbin ring 203*h* may be between the bobbin 203*d* and the display panel 100, and may transfer the vibration of the bobbin 203*d* to the display panel 100. The bobbin ring 203*h* may attach or adhere the bobbin 203*d* to the rear surface of the display panel 100. For example, the bobbin ring 203*h* may be realized as a double-sided tape, but embodiments are not limited thereto. The bobbin ring 203*h* may reduce, block, or prevent heat generated from the bobbin 203*d* from being transferred to the display panel 100, and may efficiently transfer the vibration of the bobbin 203*d* to the display panel 100.

The connection member 205 may connect the module frame 201 and the rear structure 300 with each other. For example, multiple connection members 205 may be provided, and may fix the module frame 201 to a rear surface of a second structure member 320. For example, the connection member 205 may be fixed to the rear surface of the second structure member 320 by passing through the module frame 201. The module frame 201 may include a connection member hole, and the second structure member 320 may include a connection member mounting hole. Therefore, the connection member hole of the module frame 201 and the connection member mounting hole of the second structure member 320 may be aligned so that the connection member 205 may simultaneously pass through the connection member hole and the connection member mounting hole. The connection member 205 may be connected to the connection member hole of the module frame 201 and the connection member mounting hole of the second structure member 320, and may therefore fix the sound-generating module 210 to the rear structure 300.

The rear structure 300 may include first and second structure members 310 and 320 and a hole 330. For example, the first structure member 310 may be spaced apart from the display panel 100, and may include a glass material. The second structure member 320 may overlap the display panel 100 on the first structure member 310. The second structure member 320 may be spaced apart from the display panel 100, and may be between the first structure member 310 and the display panel 100. For example, the second structure member 320 may include a metal material.

The rear structure 300 may include a hole 330 in which the vibration generator 200 may be inserted or accommodated. For example, the first and second structure members 310 and 320 may include a hole 330 in which the sound-generating module 210 may be partially inserted or accommodated. Therefore, the sound-generating module 210 may be in contact with the rear surface of the display panel 100 by passing through the hole 330.

The supporting member 400 may be between the display panel 100 and the vibration generator 200 to maintain a distance between the display panel 100 and the vibration generator 200. For example, the supporting member 400 may be between the module frame 201 and the display panel 100. The supporting member 400 may attach the front surface of the module frame 201 to the rear surface of the display panel 100. The plurality of connection members 205 may fix the vibration generator 200 to the rear structure 300. The supporting member 400 may support the vibration generator 200 from the rear surface of the display panel 100. Therefore, the display apparatus 10 may both connect and fix the vibration generator 200 through the plurality of connection members 205 and the supporting member 400. Therefore, the supporting member 400 may reduce or prevent a rolling phenomenon of the vibration generator 200 from occurring, and reduce or prevent sound distortion and a deterioration phenomenon of the display apparatus 10 from occurring.

For example, the rolling phenomenon represents a phenomenon in which the module frame 201 is not completely fixed to the rear structure 300, and therefore the module frame 201 may be shaken during vibration of the vibration generator 200. With regard to the rolling phenomenon, the inventors of the present disclosure have recognized that this rolling phenomenon may occur when the module frame 201 is connected to the rear structure 300 by depending on only the plurality of connection members 205, and that the rolling phenomenon may cause sound distortion and deterioration phenomenon of the display apparatus 10. Also, the inventors of the present disclosure have recognized that the rolling phenomenon is most prominent in a low-pitched sound band.

The display apparatus may include a partition member between the display panel and the rear structure and adjacent to the vibration generator. However, when the partition member is between the rear structure and the display panel, e.g., to block or prevent interference of a sound, the partition member cannot directly support the module frame of the vibration generator. Therefore, the inventors of the present disclosure have recognized that a rolling phenomenon of the vibration generator may not be prevented from occurring even if the display apparatus includes the partition member adjacent to the vibration generator.

Therefore, when the display apparatus 10 includes a supporting member 400 for directly bonding and fixing the module frame 201 to the rear surface of the display panel 100, the module frame 201 may be stably supported, even when the vibration generator 200 vibrates, whereby a rolling phenomenon may be reduced or prevented from occurring. Although the supporting member 400 may include the same material as that of the partition member 600, the partition member 600 may be between the display panel 100 and the rear structure 300 to prevent reduction of sound pressure level, but may not prevent a rolling phenomenon from occurring unlike the supporting member 400. Therefore, the supporting member 400 may be between the module frame 201 and the display panel 100, whereby a different configuration and effect from the partition member 600 may be obtained.

The supporting member 400 may include a material with lower elasticity than the module frame 201 and the display panel 100. When the supporting member 400 includes a material with lower elasticity than the module frame 201 and the display panel 100, the supporting member 400 may support the module frame 201 from the rear surface of the display panel 100, and at the same time may reduce or prevent vibration of the display panel 100 from being transferred to the module frame 201. Therefore, the supporting member 400 may stably support the module frame 201, may improve vibration transmission characteristic of the vibration generator 200, and may reduce or prevent a rolling phenomenon due to vibration of the vibration generator 200. For example, the supporting member 400 may include a foam pad including, e.g., acrylic material, and an adhesive layer on each of a front surface and a rear surface of the foam pad, but embodiments are not limited thereto.

The supporting member 400 may be formed on areas other than the plurality of connection areas 201*a* and vibration areas 201*b*. For example, the supporting member 400 may surround the vibration unit 203 to be spaced apart therefrom. For example, the vibration unit 203 may be at the central area of the module frame 201, and the supporting member 400 may be at the peripheries or corners of the module frame 201. The supporting member 400 may be disposed symmetrically based on the vibration unit 203. The arrangement structure of the supporting member 400 may be provided in various ways that depend on a structure and shape of the module frame 201 and arrangement relations between the vibration unit 203 and the connection member 204. Therefore, the supporting member 400 may be formed symmetrically with respect to the vibration unit 203, and therefore may stably fix the module frame 201 to the rear structure 300, in spite of vibration of the vibration unit 203.

The sound-generating module 210 may include first and second vibration units 203-1 and 203-2 that may be accommodated in one module frame 201. Therefore, the module frame 201 may include first to fourth connection areas 201*a*-1, 201*a*-2, 201*a*-3, and 201*a*-4, and may include first and second vibration areas 201*b*-1 and 201*b*-2. The supporting member 400 may include first to fourth supporting members 410, 420, 430, and 440, which may be formed on areas other than the first to the fourth connection areas 201*a*-1, 201*a*-2, 201*a*-3, and 201*a*-4 and the first and the second vibration areas 201*b*-1 and 201*b*-2.

For example, the first vibration unit 203-1 may be at the left side of the module frame 201, and the second vibration unit 203-2 may be at the right side of the module frame 201. The first to fourth connection areas 201*a*-1, 201*a*-2, 201*a*-3, and 201*a*-4 may be at respective corners of the module frame 201, and the first to fourth supporting members 410, 420, 430, and 440 may be at respective peripheries of the module frame 201. Therefore, the first to fourth supporting members 410, 420, 430, and 440 may be at respective peripheries of the module frame 201 other than at the first to fourth connection areas 201*a*-1, 201*a*-2, 201*a*-3, and 201*a*-4 and the first and second vibration areas 201*b*-1 and 201*b*-2, and may surround the first and second vibration areas 201*b*-1 and 201*b*-2 to be spaced apart therefrom. The plurality of connection members 205 may fix the vibration generator 200 to the rear structure 300, and the plurality of supporting members 400 may support the vibration generator 200 from the rear surface of the display panel 100. Therefore, the first to fourth supporting members 410, 420, 430, and 440 and the first to fourth connection areas 201*a*-1, 201*a*-2, 201*a*-3, and 201*a*-4 may both connect and fix the vibration generator 200 by surrounding the first and second vibration units 203-1 and 203-2. Therefore, the first to fourth supporting members 410, 420, 430, and 440 may stably fix the module frame 201 to the rear structure 300, in spite of vibration of the first and second vibration units 203-1 and 203-2, thereby reducing or preventing a rolling phenomenon of the vibration generator 200.

The supporting member 400 may be between the plurality of connection members 205 among the peripheries of the module frame 201. For example, the first to fourth connection areas 201*a*-1, 201*a*-2, 201*a*-3, and 201*a*-4 may be at respective corners of the module frame 201, and the first to fourth supporting members 410, 420, 430, and 440 may be at respective peripheries of the module frame 201. For example, the first supporting member 410 may be between the first and fourth connection areas 201*a*-1 and 201*a*-4, the second supporting member 420 may be between the first and second connection areas 201*a*-1 and 201*a*-2, the third supporting member 430 may be between the second and third connection areas 201*a*-2 and 201*a*-3, and the fourth supporting member 440 may be between the third and fourth connection areas 201*a*-3 and 201*a*-4. Therefore, each of the first to fourth supporting members 410, 420, 430, and 440 and each of the first to fourth connection areas 201*a*-1, 201*a*-2, 201*a*-3, and 201*a*-4 may be alternately disposed along the peripheries of the module frame 201, and may therefore surround the first and second vibration units 203-1 and 203-2 to be spaced apart therefrom and to both connect and fix the vibration generator 200.

Figure 10:
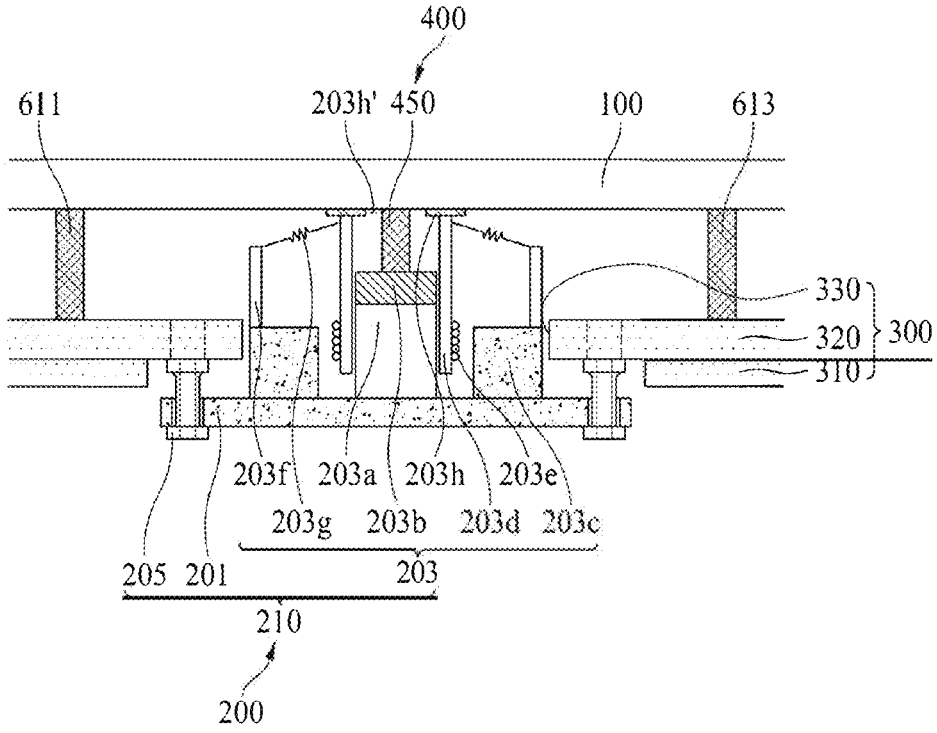
FIG. 10 is a cross-sectional view of an area A of FIG. 5 in accordance with a second example embodiment of a vibration generator.
Figure 11:
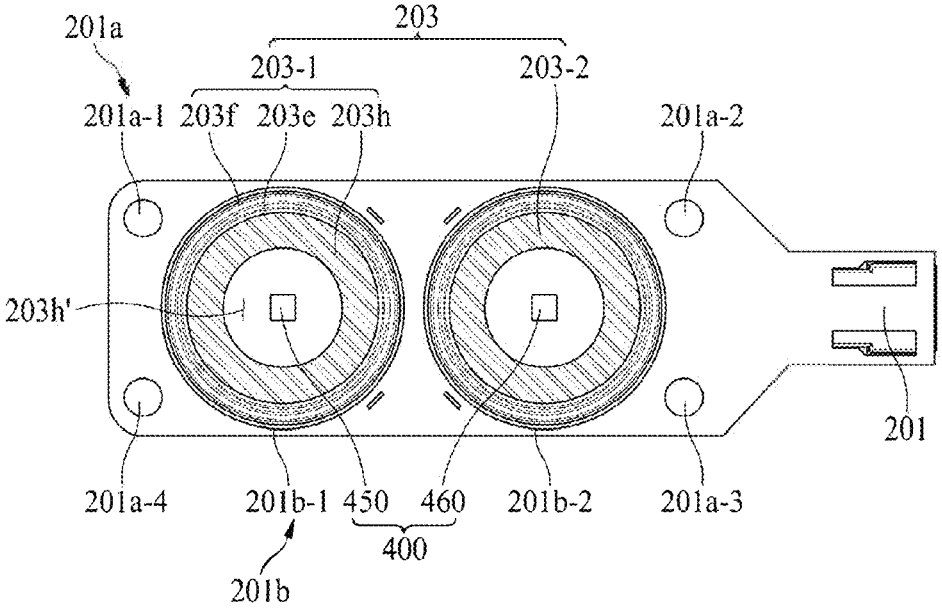
FIG. 11 is a plane view of elements of a vibration generator in a display apparatus of FIG. 10.

FIG. 10 is a cross-sectional view of an area A of FIG. 5 in accordance with a second example embodiment of a vibration generator. FIG. 11 is a plane view of elements of a vibration generator in a display apparatus of FIG. 10.

With reference to FIGS. 10 and 11, the sound-generating module 210 may include a module frame 201, a vibration unit 203, a plurality of connection members 205, and the vibration unit 203 may include a magnet member 203*a*, an upper plate 203*b*, a side frame 203*c*, a bobbin 203*d*, a coil 203*e*, an external frame 203*f*, a damper 203*g*, and a bobbin ring 203*h*. The sound-generating module 210 may include first and second vibration units 203-1 and 203-2 that may be accommodated in one module frame 201. Therefore, the module frame 201 may include first to fourth connection areas 201*a*-1, 201*a*-2, 201*a*-3, and 201*a*-4, and may include first and second vibration areas 201*b*-1 and 201*b*-2. The supporting member 400 may include first and second supporting members 450 and 460.

For example, the first vibration unit 203-1 may be at the left side of the module frame 201, and the second vibration unit 203-2 may be at the right side of the module frame 201. The first to fourth connection areas 201*a*-1, 201*a*-2, 201*a*-3, and 201*a*-4 may be at respective corners of the module frame 201. Therefore, the first to fourth connection areas 201*a*-1, 201*a*-2, 201*a*-3, and 201*a*-4 may surround the first and second vibration areas 201*b*-1 and 201*b*-2 to be spaced apart therefrom. For example, the plurality of connection members 205 may fix the vibration generator 200 to the rear structure 300, and the plurality of supporting members 400 may support the vibration generator 200 from the rear surface of the display panel 100. Therefore, the first and second supporting member 450 and 460 and the plurality of connection members 205 may both connect and fix the vibration generator 200. Therefore, the first and second supporting members 450 and 460 may stably fix the module frame 201 to the rear structure 300, in spite of vibration of the first and the second vibration units 203-1 and 203-2, thereby reducing or preventing a rolling phenomenon of the vibration generator 200 from occurring.

The supporting member 400 may be between the vibration unit 203 and the display panel 100. For example, the supporting member 400 may be between the front surface of the upper plate 203*b* and the rear surface of the display panel 100 to maintain a distance between the display panel 100 and the vibration generator 200. The supporting member 400 may attach or adhere the front surface of the upper plate 203*b* to the rear surface of the display panel 100. The bobbin ring 203*h* may include a puncturing portion 203*h*' at the center of the bobbin ring 203*h*, and the supporting member 400 may pass through the puncturing portion 203*h*' of the bobbin ring 203*h*. Therefore, the bobbin ring 203*h* and bobbin 203*d* may surround the supporting member 400 to be spaced apart therefrom. The plurality of connection members 205 may fix the vibration generator 200 to the rear structure 300, and the supporting member 400 may support the vibration generator 200 from the rear surface of the display panel 100. Therefore, the display apparatus 10 may both connect and fix the vibration generator 200 through the plurality of connection members 205 and the supporting member 400. Therefore, the supporting member 400 may reduce or prevent a rolling phenomenon of the vibration generator 200 from occurring, and may reduce or prevent sound distortion and deterioration phenomenon of the display apparatus 10 from occurring.

The supporting member 400 may include a material with lower elasticity than the upper plate 203*b* and the display panel 100. When the supporting member 400 includes a material with lower elasticity than the upper plate 203*b* and the display panel 100, the supporting member 400 may support the upper plate 203*b* from the rear surface of the display panel 100, and may, at the same time, reduce or prevent vibration of the display panel 100 from being transferred to the upper plate 203*b*. Therefore, the supporting member 400 may stably support the upper plate 203*b*, may improve a vibration transmission characteristic of the vibration generator 200, and may reduce or prevent a rolling phenomenon due to vibration of the vibration generator 200 from occurring. For example, the supporting member 400 may include a foam pad, e.g., including acrylic material, and an adhesive layer on each of front and rear surfaces of the foam pad, but embodiments are not limited thereto.

The sound-generating module 210 may include first and second vibration units 203-1 and 203-2 that may be accommodated in one module frame 201, and the supporting member 400 may include first and second supporting members 450 and 460 between each of the first and second vibration units 203-1 and 203-2 and the display panel 100. For example, the first supporting member 450 may be between the upper plate 203*b* of the first vibration unit 203-1 and the display panel 100, and the second supporting member 460 may be between the upper plate 203*b* of the second vibration unit 203-2 and the display panel 100. Therefore, the first and second supporting members 450 and 460 may reduce or prevent a rolling phenomenon from occurring by stably fixing the upper plate 203*b* of the first and second vibration units 203-1 and 203-2, in spite of vibrations of the first and second vibration units 203-1 and 203-2.

Therefore, the display apparatus 10 may reduce or prevent a rolling phenomenon that may occur while vibrating the display panel 100, and may reduce or prevent sound distortion and deterioration phenomenon from occurring by providing the supporting member 400 between the display panel 100 and the vibration generator 200.

A vibration generator according to an embodiment of the present disclosure may be applied to the vibration generator in the display apparatus. A display apparatus according to an embodiment of the present disclosure may be applied to a mobile device, a video phone, a smart watch, a watch phone, a wearable device, a foldable device, a rollable device, a bendable device, a flexible device, a curved device, an electronic diary, electronic book, a portable multimedia player (PMP), a personal digital assistant (PDA), an MP3 player, a mobile medical device, a desktop personal computer (PC), a laptop PC, a netbook computer, a workstation, a navigator, a vehicle navigator, a signage device, a game device, a television, a notebook computer, a monitor, a camera, a camcorder, and home appliances. Embodiments are not limited to these examples.

A display apparatus according to an embodiment of the present disclosure will be described below.

According to an embodiment of the present disclosure, a display apparatus may include: a display panel configured to display an image by emitting light, a rear structure configured to support the display panel, a vibration generator configured to vibrate the display panel, and a supporting member between the display panel and the vibration generator, the supporting member being configured to maintain a distance between the display panel and the vibration generator.

For example, in the display apparatus according to an embodiment of the present disclosure, the rear structure may include a hole, and the vibration generator may include: a module frame in the hole in the rear structure, a vibration unit on the module frame, the vibration unit being configured to vibrate the display panel, and a plurality of connection members configured to connect the module frame to the rear structure. For example, in the display apparatus according to an embodiment of the present disclosure, the module frame may include: a plurality of connection areas in which the plurality of connection members may be disposed, and a vibration area in which the vibration unit may be disposed.

For example, in the display apparatus according to an embodiment of the present disclosure, the supporting member may be in an area other than the plurality of connection areas and the vibration area. For example, in the display apparatus according to an embodiment of the present disclosure, the plurality of connection areas may be at respective corners of the module frame.

For example, in the display apparatus according to an embodiment of the present disclosure, the vibration unit may include first and second vibration units in the module frame, the vibration area may include first and second vibration areas for respectively accommodating the first and second vibration units, and the supporting member may be in an area other than the plurality of connection areas and the first and second vibration areas among peripheries of the module frame. For example, in the display apparatus according to an embodiment of the present disclosure, the supporting member may be between the plurality of connection members among peripheries of the module frame.

For example, in the display apparatus according to an embodiment of the present disclosure, the plurality of connection members and the supporting member may surround and may be spaced apart from the vibration unit. For example, in the display apparatus according to an embodiment of the present disclosure, the supporting member may include a material having lower elasticity than the module frame and the display panel.

For example, in the display apparatus according to an embodiment of the present disclosure, the vibration unit may include: a magnet member on the module frame, an upper plate on the magnet member, a bobbin surrounding the magnet member and in contact with a rear surface of the display panel, a coil wound on an outer circumference of the bobbin, and a bobbin ring between the bobbin and the display panel. For example, in the display apparatus according to an embodiment of the present disclosure, the supporting member may be between the vibration unit and the display panel.

For example, in the display apparatus according to an embodiment of the present disclosure, the supporting member may be between a front surface of the upper plate and a rear surface of the display panel. For example, the display apparatus according to an embodiment of the present disclosure may further include a puncturing portion at the center of the bobbin ring, and the supporting member may pass through the puncturing portion.

For example, in the display apparatus according to an embodiment of the present disclosure, the bobbin may surround and may be spaced apart from the supporting member. For example, in the display apparatus according to an embodiment of the present disclosure, the vibration generator may include first and second vibration units in the module frame, and the supporting member may include first and second supporting members respectively between each of the first and second vibration units and the display panel. For example, in the display apparatus according to an embodiment of the present disclosure, the supporting member may include a material having lower elasticity than the upper plate and the display panel.

For example, the display apparatus according to an embodiment of the present disclosure may further include a partition member between the display panel and the rear structure, the partition member separating left and right areas of the display panel. For example, in the display apparatus according to an embodiment of the present disclosure, the partition member may include first to third partition members, the first partition member surrounding the left area of the display panel, the second partition member surrounding the right area of the display panel, and the third partition member surrounding a center area of the display panel.

For example, in the display apparatus according to an embodiment of the present disclosure, at least one side of four sides in each of the first and second partition members may include a bent portion, and the bent portion may have an inclined angle with respect to a horizontal direction of the display panel. For example, the display apparatus according to an embodiment of the present disclosure may further include an adhesive member between the periphery of the display panel and the periphery of the rear structure to adhere the display panel to the rear structure.

As described above, the display apparatus according to the present disclosure may have the following advantages.

The display apparatus according to an embodiment of the present disclosure may generate sound, such that a progressing direction of the sound may be toward the front portion of the display panel. Therefore, the image of the display apparatus may be matched with the position where the sound may be generated, whereby an immersion experience of a viewer who may view the image of the display apparatus may be improved. When the display apparatus according to an embodiment of the present disclosure includes the sound generator attached to the rear surface of the display panel, the speaker may not be provided separately, whereby freedom of degree in arrangement of the speaker and aesthetic design of the set apparatus may be improved.

The display apparatus according to an embodiment of the present disclosure may reduce or prevent a rolling phenomenon, which may occur when the vibration generator vibrates the display panel, from occurring. The display apparatus according to an embodiment of the present disclosure may reduce or prevent a rolling phenomenon of the vibration generator from occurring by providing the supporting member between the display panel and the vibration generator. The display apparatus according to an embodiment of the present disclosure may reduce prevent sound distortion and deterioration from occurring by reducing or preventing the rolling phenomenon of the vibration generator from occurring.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. A display apparatus, comprising:

a display panel configured to display an image by emitting light;

a rear structure configured to support the display panel;

a vibration generator configured to vibrate the display panel; and a supporting member in the vibration generator, the supporting member being configured to maintain a distance between the display panel and the vibration generator, wherein the supporting member comprises a material having lower elasticity than the display panel.

2. The display apparatus of claim 1, wherein the vibration generator comprises:

a magnet member on a module frame;

an upper plate on the magnet member;

a bobbin surrounding the magnet member and in contact with a rear surface of the display panel;

a coil wound on an outer circumference of the bobbin; and a bobbin ring between the bobbin and the display panel.

3. The display apparatus of claim 2, wherein the supporting member is on the upper plate.

4. The display apparatus of claim 2, wherein the supporting member is between a front surface of the upper plate and a rear surface of the display panel.

5. The display apparatus of claim 2, wherein the bobbin is configured to surround the supporting member.

6. The display apparatus of claim 2, wherein the module frame is configured to support a lower portion of the magnetic member.

7. The display apparatus of claim 2, wherein:

the vibration generator comprises first and second vibration units in the module frame;

the first vibration unit is in a left side of the module frame; and the second vibration unit is a right side of the module frame.

8. The display apparatus of claim 2, wherein:

the vibration generator comprises first and second vibration units in the module frame; and the supporting member comprises first and second supporting members respectively between each of the first and second vibration units and the display panel.

9. The display apparatus of claim 2, wherein the module frame includes a plurality of connection areas, the plurality of connection areas is at corners of the module frame.

10. The display apparatus of claim 2, wherein the material of the supporting member has lower elasticity than the upper plate.

11. The display apparatus of claim 2, further comprising:

a bobbin ring between the bobbin and the display panel; and a puncturing portion at the center of the bobbin ring, wherein the supporting member passes through the puncturing portion.

12. The display apparatus of claim 1, further comprising a partition member between the display panel and the rear structure, the partition member separating left and right areas of the display panel.

13. The display apparatus of claim 12, wherein the partition member includes first to third partition members, the first partition member surrounding the left area of the display panel, the second partition member surrounding the right area of the display panel, and the third partition member surrounding a center area of the display panel.

14. The display apparatus of claim 13, wherein:

at least one side of four sides in each of the first and second partition members includes a bent portion; and the bent portion has an inclined angle with respect to a horizontal direction of the display panel.

15. The display apparatus of claim 1, further comprising an adhesive member between the periphery of the display panel and the periphery of the rear structure to adhere the display panel to the rear structure.

16. The display apparatus of claim 1, wherein the rear structure includes a first structure member and a second structure member, the second structure member is between the first structure member and the display panel.

17. A display apparatus, comprising:

a display panel configured to display an image by emitting light;

a rear structure configured to support the display panel;

a vibration generator configured to vibrate the display panel;

a module frame configured to support the vibration generator; and a supporting member between the display panel and the module frame, wherein the supporting member comprises a material having lower elasticity than the module frame and the display panel.

18. The display apparatus of claim 17, wherein the supporting member is configured to maintain a distance between the display panel and the vibration generator.

19. The display apparatus of claim 17, wherein:

the supporting member comprises first to fourth supporting members at peripheries of the module frame; and the module frame comprises first to fourth connection areas at corners of the module frame.

20. The display apparatus of claim 19, wherein:

the first supporting member is between the first connection area and the fourth connection area;

the second supporting member is between the first connection area and the second connection area;

the third supporting member is between the second connection area and the third connection area; and the fourth supporting member is between the third connection area and the fourth connection area.

* * * * *